US009004225B2

(12) United States Patent
Wakatsuki

(10) Patent No.: US 9,004,225 B2
(45) Date of Patent: Apr. 14, 2015

(54) SILENCING APPARATUS FOR A VEHICLE

(75) Inventor: Kazutoshi Wakatsuki, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 13/702,183

(22) PCT Filed: Jul. 27, 2011

(86) PCT No.: PCT/JP2011/067141
§ 371 (c)(1),
(2), (4) Date: Dec. 5, 2012

(87) PCT Pub. No.: WO2013/014771
PCT Pub. Date: Jan. 31, 2013

(65) Prior Publication Data
US 2014/0196980 A1 Jul. 17, 2014

(51) Int. Cl.
*F01N 1/08* (2006.01)

(52) U.S. Cl.
CPC ..... *F01N 1/089* (2013.01); *F01N 2470/20* (2013.01); *F01N 2490/06* (2013.01)

(58) Field of Classification Search
USPC ..... 181/251, 257, 264, 265, 268, 272, 275
See application file for complete search history.

(56) References Cited

U.S. PATENT DOCUMENTS 6,189,650 B1 * 2/2001 Inuzuka et al. ..... 181/254

FOREIGN PATENT DOCUMENTS

| | | | | |
|---|---|---|---|---|
| JP | S53-027113 | | 3/1978 | |
| JP | 55049501 | A * | 4/1980 | ..... F01C 1/02 |
| JP | A-60-175718 | | 9/1985 | |
| JP | S63-285213 | | 11/1988 | |
| JP | U-3011359 | | 5/1995 | |
| JP | A-2005-171933 | | 6/2005 | |
| JP | A-2009-062922 | | 3/2009 | |
| JP | A-2012-145097 | | 8/2012 | |
| WO | WO 2009/031012 | A2 | 3/2009 | |

OTHER PUBLICATIONS

Jul. 15, 2014 Office Action issued in Chinese Application No. 201180020744.4 (English Translation Only).
Japanese Patent Office, Notice of Reasons for Rejection dated Sep. 24, 2014 in Japanese Patent Application No. 2011-164450 w/English-language Translation.

* cited by examiner

*Primary Examiner* — Jeremy Luks
(74) *Attorney, Agent, or Firm* — Oliff PLC

(57) ABSTRACT

A muffler has a flattened cross-sectional shape the width of which is greater than its height. The muffler includes therein a plurality of expansion chambers. The muffler also includes an inlet pipe, an outlet pipe and first to third communication pipes, through which the expansion chambers are open to the outside. All of an opening of the inlet pipe, an opening of the outlet pipe and openings of the first to third communication pipes formed in the muffler are arranged such that they fall between a position separated away from one end of the muffler in its width direction by a ¼ length of the width of the muffler and a position separated away from the end of the muffler by a ½ length of the width.

3 Claims, 9 Drawing Sheets

W

λ=2W

λ=W

SILENCING APPARATUS FOR A VEHICLE

FIELD OF THE INVENTION

The present invention relates to a silencing apparatus for a vehicle that includes a muffler having a flattened cross-sectional shape, the width of which is greater than its height, an inlet pipe, through which exhaust is introduced into the muffler, an outlet pipe, through which exhaust is discharged from the muffler, a partition plate, which partitions the interior of the muffler to form an expansion chamber, and a communication hole, which extends through the partition plate.

BACKGROUND OF THE INVENTION

As a silencing apparatus for a vehicle, there is a muffler located in an exhaust system of an internal combustion engine. The muffler installed under the floor of a vehicle has a flat cross-sectional shape such as an ellipse or a long circle, the width of which is greater than its height, so that the muffler is easily assembled to the vehicle.

A muffler of a flattened cross-sectional shape having a width W as shown in FIG. 11(*a*) will be discussed. According to such a muffler, air column resonance, in which both ends of the muffler in its width direction are closed, is generated in the width direction, and silencing performance of the muffler is deteriorated. A wavelength λ of a stationary wave that generates air column resonance in the width direction of the muffler is 2W/n (n: integer not less than 1). If sound velocity is defined as "C ($C \approx 20 \times \sqrt{T}$, T: gas temperature in muffler)", the frequency f of the air column resonance is C×m/2W (m: integer not less than 1). Of the air column resonance, ones that appear most outstandingly are two stationary waves, i.e., a stationary wave (λ=2W) in which the wavelength λ is twice the muffler width as shown in FIG. 11(*b*), and a stationary wave (λ=W) in which the wavelength λ is equal to the muffler width as shown in FIG. 11(*c*).

Conventionally, as countermeasures against high frequency exhaust sound such as the air column resonance in the width direction of the muffler, a sub-muffler, which has a high frequency resonance structure and into which a sound absorbing material is charged, is installed in an exhaust system as shown in Patent Document 1.

PRIOR ART DOCUMENT

Patent Document

Patent Document 1: Japanese Laid-Open Patent Publication No. 2009-062922

SUMMARY OF THE INVENTION

If a sub-muffler is appropriately designed, increase in exhaust sound caused by air column resonance in the width direction of the muffler can admittedly be suppressed. However, installation of the sub-muffler inevitably increases the costs and mass, correspondingly. Therefore, it is desired to realize a silencing apparatus for a vehicle capable of inexpensively and effectively suppress the increase in the exhaust sound caused by the air column resonance in the width direction of the muffler.

Accordingly, it is an objective of the present invention to provide a silencing apparatus for a vehicle capable of effectively suppressing the increase in exhaust sound caused by air column resonance in the width direction of a muffler.

<Solving Principle of Invention>

A solving principle of the problem according to the present invention will be described first. A case discussed below is that openings 52 and 53 communicate with outside of the expansion chamber 51 are formed in an expansion chamber 51 formed in a muffler 50 of a flattened cross-sectional shape having a width W as shown in FIG. 1. The opening 52 is formed in the expansion chamber 51 at a position separated away from one end (right end in the drawing) of the expansion chamber 51 in the width direction by a ¼ length (W/4) of the width W, and the opening 53 is formed in the expansion chamber 51 at a position separated away from the end by a ½ length (W/2) of the width W. The opening 52 is located such that its left end in the drawing comes into contact with the position that is separated away from the one end of the muffler 50 in the width direction by W/2. The opening 53 is located such that its right end in the drawing comes into contact with the position that is separated away from the one end of the muffler 50 in the width direction by W/4.

According to the muffler 50, air column resonance is generated by two stationary waves, i.e., a stationary wave (λ=2W) in which the wavelength λ is twice the width W of the muffler 50 in the width direction, and a stationary wave (λW) in which the wavelength λ is equal to the width W of the muffler 50 in the width direction. That is, in the muffler 50, resonance is generated in two modes, i.e., a one-node-in-muffler resonance mode, in which the wavelength λ is twice the width W of the muffler 50, and a two-nodes-in-muffler resonance mode, in which the wavelength λ is equal to the width W of the muffler 50.

The opening 52 will now be mainly considered. As shown in FIG. 1(*a*), a space on the right side of the opening 52 is open to the outside through the opening 53. A hatched space on the left side of the opening 52 is a closed space, which is not open to the outside. This closed space functions as an acoustic pipe of the length of W/2. This acoustic pipe generates a stationary wave of reversed phase by resonance with respect to air column resonance of wavelength λ=2W, and exerts sound-absorbing effect (resonance mode of ½ position open end).

If the opening 53 is mainly considered on the other hand, as shown in FIG. 1(*b*), a space on the left side of the opening 53 is open to the outside through the opening 52. A hatched space on the right side of the opening 53 is a closed space, which is not open to the outside. This closed space functions as an acoustic pipe of the length of W/4. This acoustic pipe generates a stationary wave of reversed phase by resonance with respect to air column resonance of wavelength λ=W and exerts sound-absorbing effect (resonance mode of ¼ position open end).

According to the expansion chamber 51 of the muffler 50, in which the openings 52 and 53 are formed at the above-described positions, the sound-absorbing effect is exerted on, of the air column resonance in the width direction, the air column resonance of the wavelength λ=2W and the air column resonance of the wavelength λ=W, which appear most outstandingly. Hence, according to the muffler 50, in which the openings 52 and 53, which communicate with outside, are formed at the position separated away from the one end of the muffler 50 in the width direction by the ¼ length of the width W and at the position separated away from the one end by the ½ length of the width W, it is possible to effectively suppress the increase in exhaust sound caused by the air column resonance of the muffler in the width direction, without providing a sub-muffler.

Means for Solving the Problems

To achieve the foregoing objective and in accordance with one aspect of the present invention, a silencing apparatus for a vehicle is provided that includes a muffler having a flattened cross-sectional shape, the width of which is greater than its height, an inlet pipe, through which exhaust is introduced into the muffler, an outlet pipe, through which exhaust is discharged from the muffler, a partition plate, which partitions an interior of the muffler to form a plurality of expansion chambers, and a communication hole, which extends through the partition plate. All of an opening of the inlet pipe, an opening of the outlet pipe, and the communication hole formed in the muffler are arranged such that the openings and the hole fall between a position separated away from one end of the muffler in its width direction by a ¼ length of the width of the muffler and a position separated away from the one end of the muffler by a ½ length of the width.

As described above, in the muffler, the openings and the communication hole, through which the expansion chamber is open to the outside, are formed at the position separated away from the one end of the muffler in the width direction by the ¼ length of the width W and at the position separated away from the one end by the ½ length of the width W. According to the muffler, of the air column resonance in the width direction, the sound-absorbing effect is exerted on the air column resonance of the wavelength λ 2W and the air column resonance of the wavelength λ=W, which appear most outstandingly. Hence, according to this configuration, it is possible to effectively suppress the increase in exhaust sound caused by the air column resonance of the muffler in the width direction, without providing a sub-muffler.

Further, according to the silencing apparatus for a vehicle of the present invention, even if the openings of the inlet pipe and the outlet pipe as well as the communication hole, which extends through the partition plate, are increased in diameter, the silencing effect is obtained. Therefore, it is possible to suppress the increase in exhaust sound caused by the air column resonance, and to reduce a back pressure caused by increase in the diameter of the openings and the communication hole.

To further reliably suppress the increase in exhaust sound, it is preferable that at least one of the opening of the inlet pipe, the opening of the outlet pipe and the communication hole be in contact with the position separated away from the one end of the muffler in the width direction by the ¼ length of the width of the muffler, and at least one of the remainder of the opening of the inlet pipe, the opening of the outlet pipe and the communication hole be in contact with the position separated away from the one end of the muffler by the ½ length of the width.

Also, to achieve the foregoing objective and in accordance with another aspect of the present invention, a silencing apparatus for a vehicle is provided that includes a muffler having a flattened cross-sectional shape the width of which is greater than its height, an inlet pipe, through which exhaust is introduced into the muffler, an outlet pipe, through which exhaust is discharged from the muffler, a partition plate, which partitions an interior of the muffler to form a plurality of expansion chambers, and a communication hole, which extends through the partition plate. All of the expansion chambers are formed such that the expansion chambers are open to the outside only in a region between a position separated away from one end of the muffler in its width direction by a ¼ length of the width of the muffler and a position separated away from the one end of the muffler by a ½ length of the width.

In this case also, the openings/communication hole, through which the expansion chamber is open to the outside, are formed between the position separated away from the one end of the muffler in the width direction by the ¼ length of the width W and the position separated away from the one end of the muffler by the ½ length of the width W. Of the air column resonance of the muffler in the width direction, the sound-absorbing effect is exerted on the air column resonance of the wavelength λ=2W and the air column resonance of the wavelength λ=W, which appear most outstandingly. Hence, according to the above configuration, it is possible to effectively suppress the increase in exhaust sound caused by the air column resonance of the muffler in the width direction, without providing a sub-muffler.

BRIEF DESCRIPTION OF THE DRAWINGS

FIG. 1(*b*) shows a waveform of stationary waves respectively generated in a two-nodes-in-muffler resonance mode and a resonance mode of a ¼ position open end in the muffler;

FIG. 2(*b*) is a cross-sectional plan view showing a cross-sectional structure of the muffler of FIG. 2(*a*);

FIG. 5(*b*) is a cross-sectional front view showing a cross-sectional structure of the muffler of FIG. 5(*a*);

FIG. 7(*b*) is a cross-sectional front view showing a cross-sectional structure of the muffler of FIG. 7(*a*);

FIG. 9(*b*) is a cross-sectional front view showing a cross-sectional structure of the muffler of FIG. 9(*a*);

FIGS. 11(*b*) and 11(*c*) are graphs showing waveforms of stationary waves generated by air column resonance in the muffler of FIG. 11(*a*).

DETAILED DESCRIPTION OF THE PREFERRED EMBODIMENTS

First Embodiment

A silencing apparatus for a vehicle according to a first embodiment of the present invention will now be described with reference to FIGS. 2 to 4.

Figure 1:
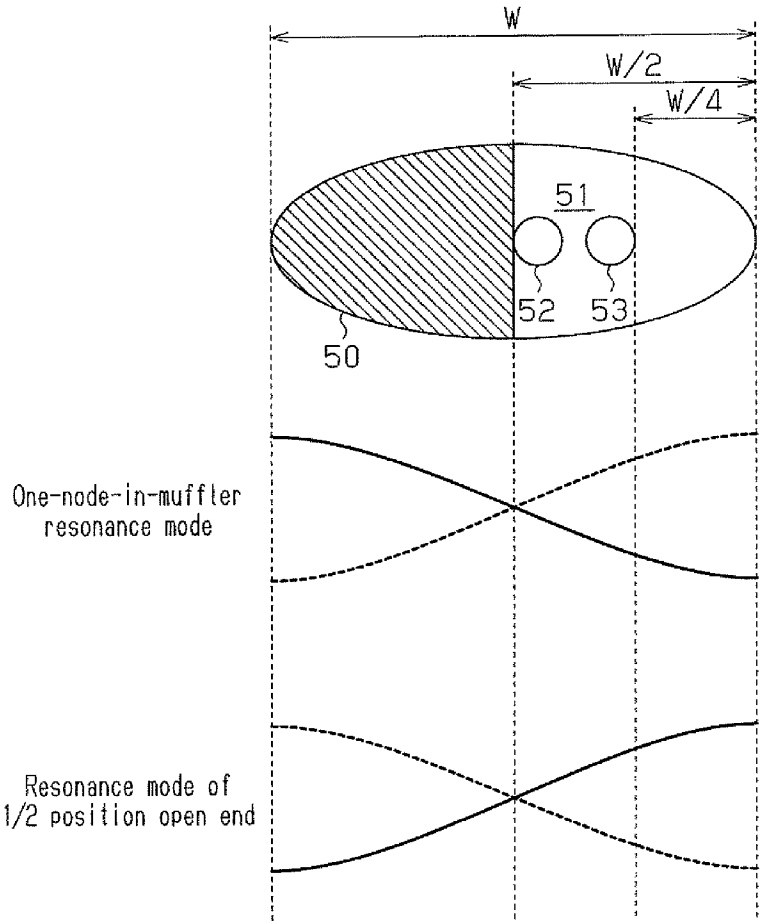
FIG. 1(*a*) shows waveforms of stationary waves respectively generated in a one-node-in-muffler resonance mode and a resonance mode of a ½ position open end in the muffler, which is a model for explaining a solving principle of the present invention.
Figure 1:
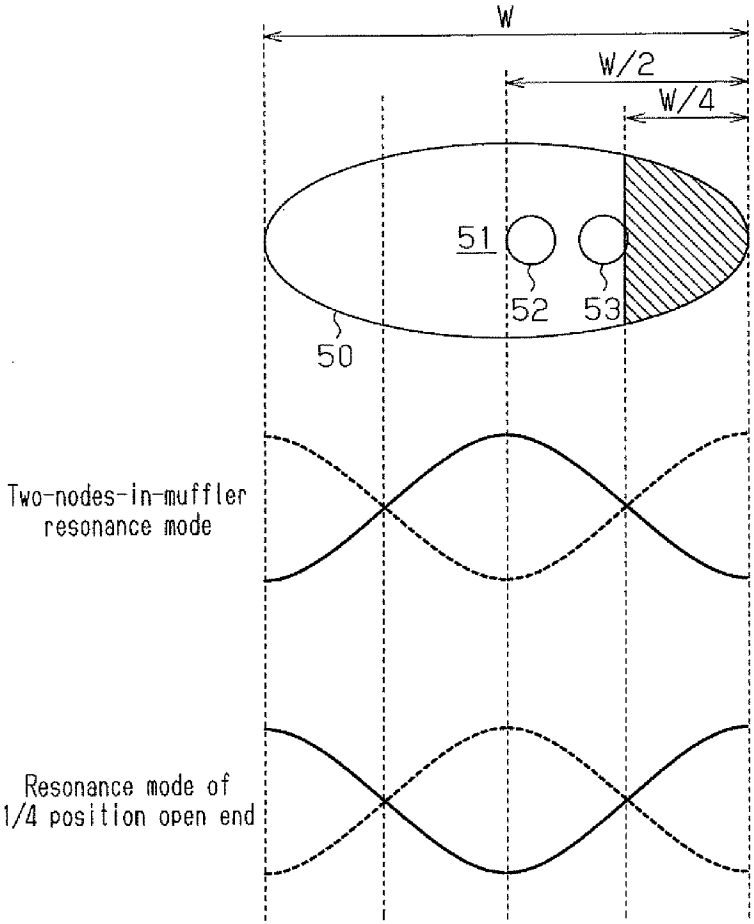
Figure 2A:
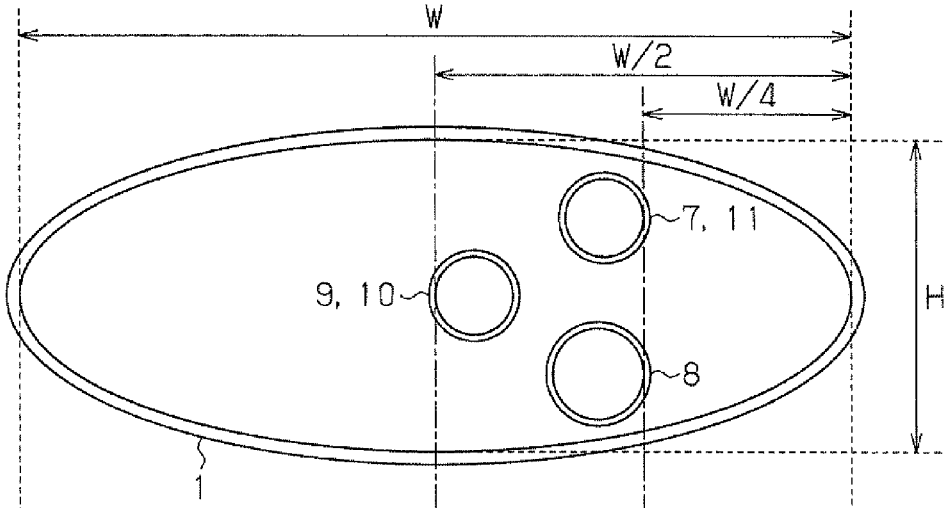
FIG. 2(*a*) is a front view showing a front structure of the muffler in a silencing apparatus for a vehicle according to a first embodiment of the invention.
Figure 2B:
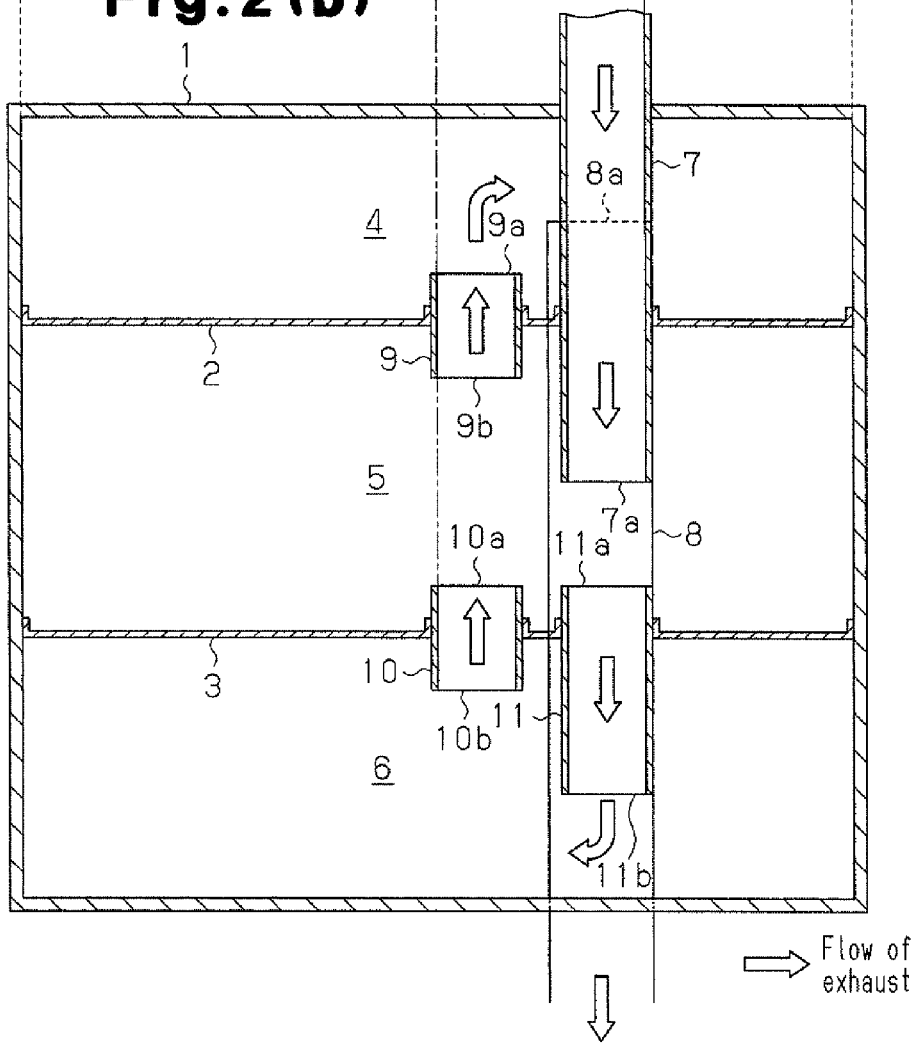

As shown in FIG. 2(*a*), a muffler 1 has a flattened cross-sectional shape (ellipse shape) the width W of which is greater than a height H thereof. As shown in FIG. 2(*b*), the interior of the muffler 1 is divided by a first partition plate 2 and a second partition plate 3 in a front-rear direction of the muffler into three expansion chambers, i.e., a first expansion chamber 4, a second expansion chamber 5 and a third expansion chamber 6. The expansion chambers 4 to 6 are formed such that the length of each expansion chamber in the front-rear direction of the muffler 1 is not less than ¼ of the width W of the muffler 1.

A circular inlet pipe 7, through which exhaust is introduced into the muffler 1, is arranged such that a right end of the inlet pipe 7 in the drawing is in contact with a position separated away from a right end of the muffler 1 in the drawing by a ¼ length (W/4) of the width W in the width direction (horizontal direction) of the muffler 1. A tip end of the inlet pipe 7 extends through the first partition plate 2 and opens into the second expansion chamber 5.

A circular outlet pipe 8, through which exhaust is discharged from the muffler 1, is arranged such that a right end of the outlet pipe 8 in the drawing is in contact with a position separated away from the right end of the muffler 1 in the drawing by the ¼ length (W/4) of the width W in the width direction of the muffler 1. A tip end of the outlet pipe 8 extends through the second partition plate 3 and the first partition plate 2 and opens into the first expansion chamber 4.

Circular first communication pipe 9, second communication pipe 10 and third communication pipe 11 are arranged such that these pipes 9 to 11 extend through the first partition plate 2 and the second partition plate 3. The first communication pipe 9 and the second communication pipe 10 are arranged such that their left ends in the drawing are in contact with positions separated away from the right end of the muffler 1 in the drawing by a ½ length (W/2) of the width W in the width direction of the muffler 1. The third communication pipe 11 is arranged such that its right end in the drawing is in contact with a position separated away from the right end of the muffler 1 in the drawing by the ¼ length (W/4) of the width W in the width direction of the muffler 1. The first expansion chamber 4 and the second expansion chamber 5 communicate with each other through the first communication pipe 9, and the second expansion chamber 5 and the third expansion chamber 6 communicate with each other through the second communication pipe 10 and the third communication pipe 11. That is, according to the muffler 1, communication holes, which extend through the first partition plate 2 and the second partition plate 3, are formed by the first communication pipe 9, the second communication pipe 10 and the third communication pipe 11.

Figure 3A:
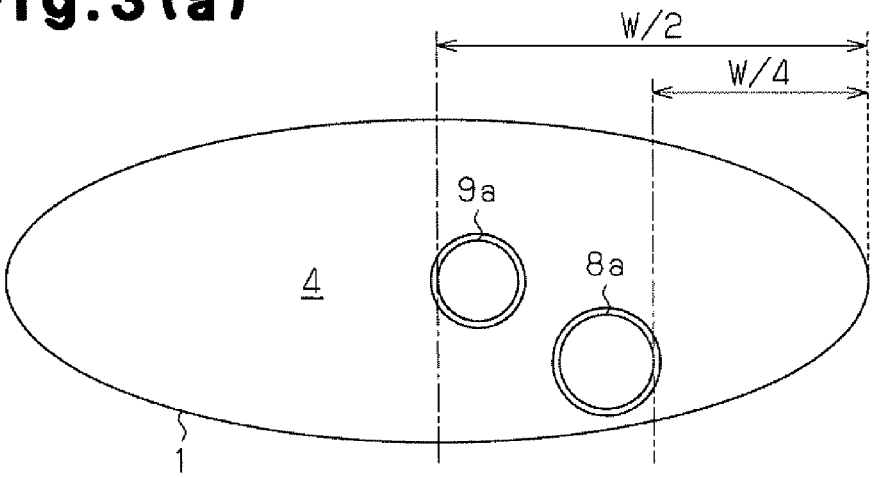
FIGS. 3(*a*) to 3(*c*) show layout of openings and a communication hole of expansion chambers of the muffler of the first embodiment.
Figure 3B:
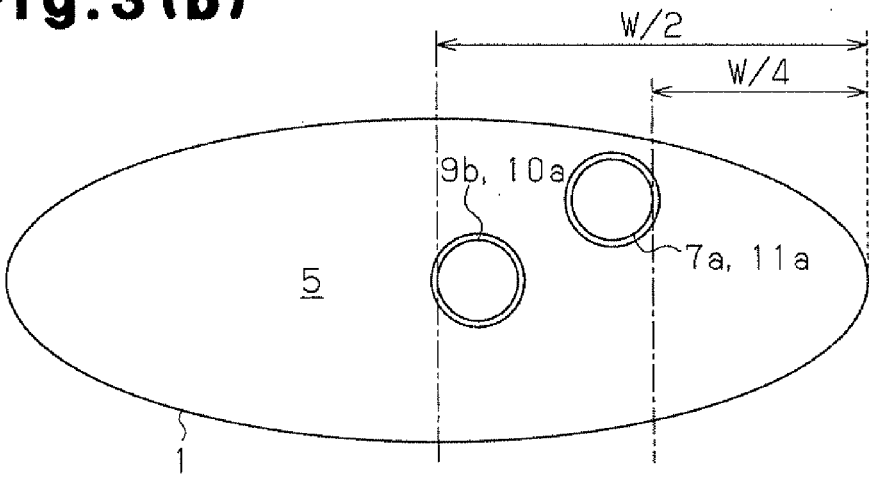
Figure 3C:
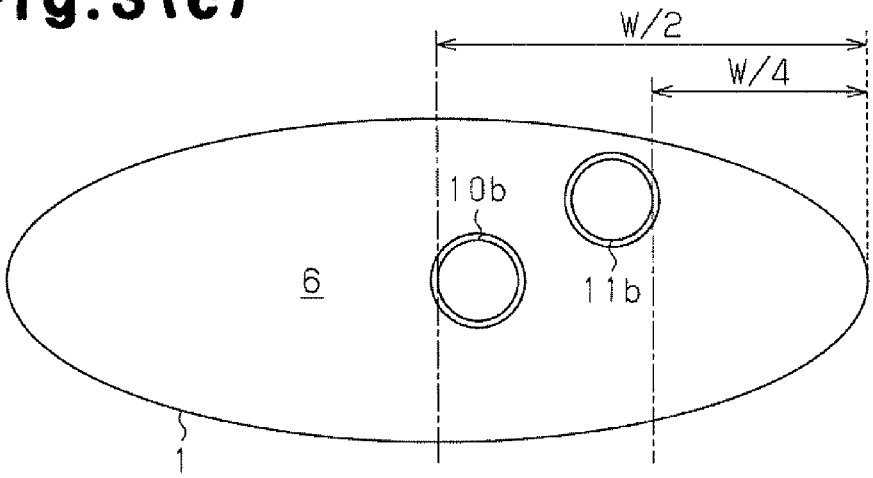

As shown in FIG. 3(*a*), an opening 8*a* of the outlet pipe 8 and an opening 9*a* of the first communication pipe 9 are located in the first expansion chamber 4 of the muffler 1 such that these openings 8*a* and 9*a* fall between a position separated away from the right end of the muffler 1 in the width direction in the drawing by the ¼ length of the width W and a position separated away from the right end of the muffler 1 by the ½ length of the width W. The opening 8*a* of the outlet pipe 8 is arranged such that its right end in the drawing is in contact with a position separated away from the right end of the muffler 1 in the width direction in the drawing by the ¼ length of the width W, and the opening 9*a* of the first communication pipe 9 is arranged such that its left end in the drawing is in contact with a position separated away from the right end of the muffler 1 in the width direction in the drawing by the ½ length of the width W.

As shown in FIG. 3(*b*), an opening 7*a* of the inlet pipe 7, an opening 9*b* of the first communication pipe 9, an opening 10*a* of the second communication pipe 10 and an opening 11*a* of the third communication pipe 11 are located in the second expansion chamber 5 of the muffler 1 such that these openings 7*a*, 9*b*, 10*a* and 11*a* fall between a position separated away from the right end of the muffler 1 in the width direction in the drawing by the length W/4 and a position separated away from the right end of the muffler 1 by the length W/2. The opening 7*a* of the inlet pipe 7 and the opening 11*a* of the third communication pipe 11 are arranged such that right ends of these openings 7*a* and 11*a* are in contact with a position separated away from the right end of the muffler 1 in the width direction in the drawing by the ¼ length of the width W. The opening 9*a* of the first communication pipe 9 and the opening 10*a* of the second communication pipe 10 are arranged such that left ends of the opening 9*a* and the opening 10*a* in the drawing are in contact with a position separated away from the right end of the muffler 1 in the width direction in the drawing by the ½ length of the width W.

As shown in FIG. 3(*c*), an opening 10*b* of the second communication pipe 10 and an opening 11*b* of the third communication pipe 11 are located in the third expansion chamber 6 of the muffler 1 such that the openings 10*b* and 11*b* fall between a position separated away from the right end of the muffler 1 in the width direction in the drawing by the ¼ length of the width W and a position separated away from the right end of the muffler 1 by the ½ length of the width W. The opening 11*b* of the third communication pipe 11 is arranged such that a right end of the opening 11*b* in the drawing is in contact with a position separated away from the right end of the muffler 1 in the width direction in the drawing by the ¼ length of the width W, and the opening 10*b* of the second communication pipe 10 is arranged such that a left end the opening 10*b* in the drawing is in contact with a position separated away from the right end of the muffler 1 in the width direction in the drawing by the ½ length of the width W.

As described above, according to the muffler 1, all of the openings of the inlet pipe 7, the outlet pipe 8 and the first to third communication pipes 9 to 11 are arranged such that the openings fall between the position separated away from the one end of the muffler 1 in the width direction by the ¼ length of the width W and the position separated away from the end of the muffler 1 by the ½ length of the width W. In all of the first expansion chamber 4, the second expansion chamber 5 and the third expansion chamber 6, all of the openings and the communication hole that communicate with outside are arranged such that they fall between the position separated away from the one end of the muffler 1 in the width direction by the ¼ length of the width W and the position separated away from the end of the muffler 1 by the ½ length of the width W.

As described above, an acoustic pipe having a length W/2 and an acoustic pipe having a length W/4 are formed in the expansion chamber the openings and communication hole of which are arranged such that they fall between the position separated away from the one end of the muffler 1 in the width direction by the ¼ length of the width W and the position separated away from the end by the ½ length of the width W. Hence, according to the muffler, silencing effect on air column resonance of wavelength λ=2W and air column resonance of wavelength λ=W is exerted in all of the expansion chambers 4 to 6.

The following equation (1) shows silencing characteristics of an expansion chamber having open ends at two locations. A left-hand side of the equation (1) represents silencing characteristics of the muffler 1, and a first term of a right-hand side represents silencing performance as a closed space of the expansion chamber. Second and third terms of the right-hand side represent silencing characteristics of an acoustic pipe formed in a closed space extending from an opening to a closed end.

[Equation 1]

$$20\log|Z_3Y_f| = 20\log m_{23} + 20\log|\sin kW| - 20\log|\cos kW_a| - 20\log|kW_b| \quad (1)$$

$S_2$: the cross-sectional area of the muffler,
$S_3$: the cross-sectional area of the opening
$m_{23}$: the expansion ratio ($S_2/S_3$)
m: an integer greater than or equal to 1
C: $20\times\sqrt{T}$
T: the gas temperature
W: the width of muffler
$W_a$, $W_b$: the length of the muffler from an end in the width direction to the opening
k: the wavelength constant ($2\pi f/c$)

Figure 4:
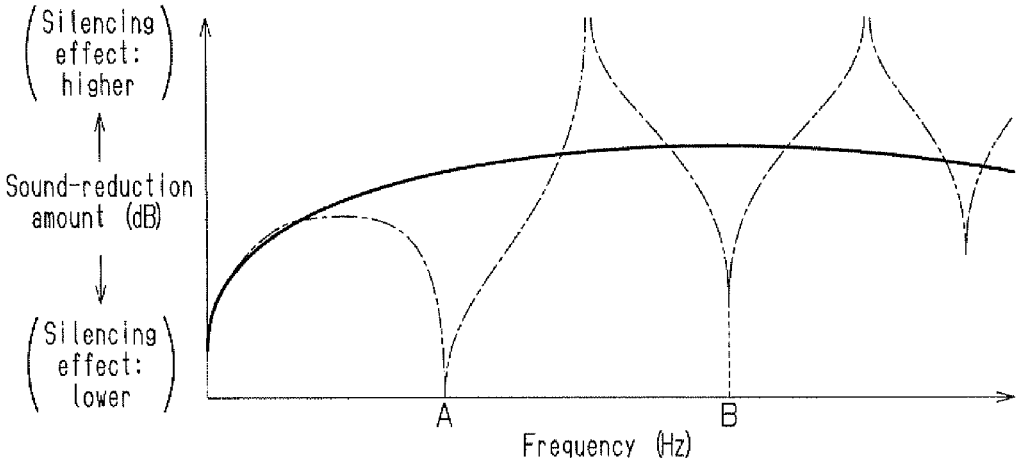
FIG. 4 is a graph showing a sound-reduction amount in wavelengths of the muffler of the first embodiment in comparison with a case where positions of the openings and the communication hole are not optimized.

FIG. 4 shows a relationship between frequency and a sound-reduction amount in the muffler 1 derived from the equation (1). When Wa and Wb in the equation (1) are not appropriately tuned, as shown by lines formed by a long dash alternating with a short dash in FIG. 4, the sound-reduction amount is largely reduced at frequencies A and B. The frequencies A and B are of air column resonance having amplitude of twice the width W of the muffler 1 and of air column resonance having amplitude which is equal to the width W.

When Wa in the equation (1) is set to ½ of the width W of the muffler 1 and Wb is set to ¼ of the width W, a region where the sound-reduction amount is largely lowered is eliminated as shown by a solid line in FIG. 4. This is because the frequency of the air column resonance and the frequency where the silencing effect of the acoustic pipe formed by the closed space is exerted match with each other. The frequency of resonance when the interior of the muffler 1 is formed as a space the both ends of which are closed is as shown in the following equation (2), and the frequency of resonance when the interior of the muffler 1 is formed as a space only one side of which is closed is as shown in the following equations (3) and (4). As apparent from these equations, if Wa=W/2 and Wb=W/4, the frequency of resonance when both ends are closed and the frequency of resonance when one end is closed match with each other, and the stationary wave caused by the air column resonance is reduced.

[Equation 2]

$$f = \frac{C}{2W}\times m \quad (2)$$

$$f = \frac{C}{2Wa}\times(2m-1) \quad (3)$$

$$f = \frac{C}{2Wb}\times(2m-1) \quad (4)$$

According to the silencing apparatus for a vehicle of the embodiment, the following advantages are achieved.

(1) In this embodiment, all of the openings 7*a* and 8*a* of the inlet pipe 7 and the outlet pipe 8, the communication holes formed in the first and second partition plates 2 and 3 by the first to third communication pipes 9 to 11 are arranged such that the openings 7*a* and 8*a* and the communication holes fall between the position separated away from the one end of the muffler 1 in the width direction by the ¼ length of the width W and the position separated away from the end of the muffler 1 by the ½ length of the width W. Hence, it is possible to effectively suppress the increase in the exhaust sound caused by the air column resonance of the muffler in its width direction, without providing a sub-muffler.

(2) In all of the expansion chambers 4 to 6 of the muffler 1 in the embodiment, all of the openings and communication holes that communicate with the outside are arranged such that they fall between the position separated away from the one end of the muffler 1 in the width direction by the ¼ length of the width W and the position separated away from the end of the muffler 1 by the ½ length of the width W. Hence, in each of the first to third expansion chambers 4 to 6, silencing effect is exerted on the air column resonance of wavelength λ=2W and air column resonance of wavelength λ=W, and high silencing effect is obtained.

(3) Even if diameters of the openings 7*a* and 8*a* of the inlet pipe 7 and the outlet pipe 8, and diameters of the communication holes, which extend through the first partition plate 2 and the second partition plate 3, are increased, the silencing effect is obtained. Therefore, it is possible to suppress the increase in exhaust sound caused by the air column resonance, and to reduce a back pressure caused by increase in diameters of the openings and communication holes.

(4) In the embodiment, all of the expansion chambers 4 to 6 are formed such that they are open to the outside only in the region between the position separated away from the one end of the muffler 1 in the width direction by the length W/4 and the position separated away from the end of the muffler 1 by the length W/2. Hence, it is possible to effectively suppress the increase in the exhaust sound caused by the air column resonance of the muffler in its width direction, without providing a sub-muffler.

Second Embodiment

Next, a silencing apparatus for a vehicle according to a second embodiment of the present invention will be described with reference to FIGS. 5 and 6.

Figure 5A:
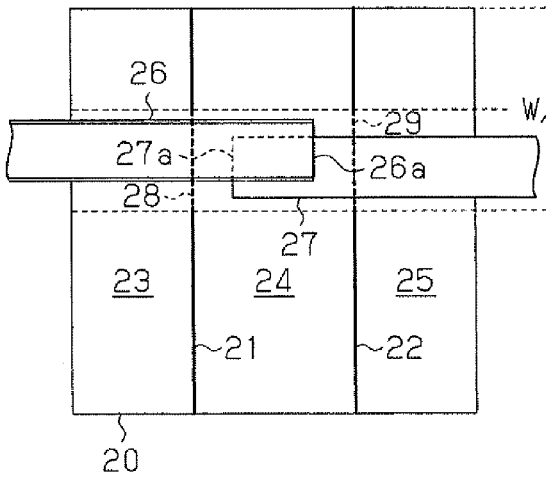
FIG. 5(*a*) is a cross-sectional plan view showing a cross-sectional structure of a muffler in a silencing apparatus for a vehicle according to a second embodiment of the invention.
Figure 5B:
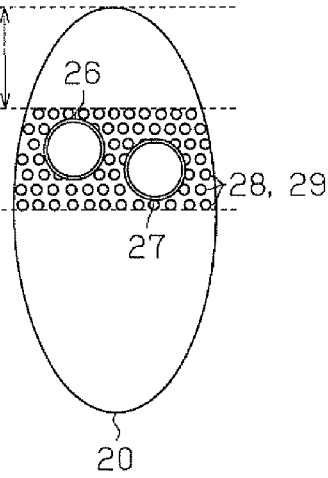

As shown in FIGS. 5(*a*) and 5(*b*), the interior of a muffler 20 having a flattened cross-sectional shape is divided by a first partition plate 21 and a second partition plate 22 into three spaces, i.e., a first expansion chamber 23, a second expansion chamber 24 and a third expansion chamber 25. The expansion chambers 23 to 25 are formed such that the length of each expansion chamber in the front-rear direction of the muffler 20 is not less than ¼ of the width W of the muffler 20.

A circular inlet pipe 26, through which exhaust is introduced into the muffler 20, is arranged such that a tip end of the inlet pipe 26 extends through the first partition plate 21 and opens into the second expansion chamber 24. A circular outlet pipe 27, through which exhaust is discharged from the muffler 20, is arranged such that a tip end of the outlet pipe 27 extends through the second partition plate 22 and opens into the second expansion chamber 24. The openings 26*a* and 27*a* of the inlet pipe 26 and the outlet pipe 27 are arranged such that the openings 26*a* and 27*a* fall between a position separated away from one end (upper end in the drawing) of the muffler 20 in its width direction by a ¼ length of the width W of the muffler 20 and a position separated away from the end by a ½ length of the width W.

A large number of punch holes 28 and 29 are formed in the first partition plate 21 and the second partition plate 22 of the muffler 20. The punch holes 28 and 29 are formed in a region between a position separated away from the one end (upper end in the drawing) of the muffler 20 in the width direction by the ¼ length of the width W of the muffler 20 and a position separated away from the end by the ½ length of the width W. Communication holes, which extend between the first expansion chamber 23 and the second expansion chamber 24, are formed by the punch holes 28 formed in the first partition plate 21, and communication holes, which extend between the second expansion chamber 24 and the third expansion chamber 25, are formed by the punch holes 29 formed in the second partition plate 22.

Figure 6A:
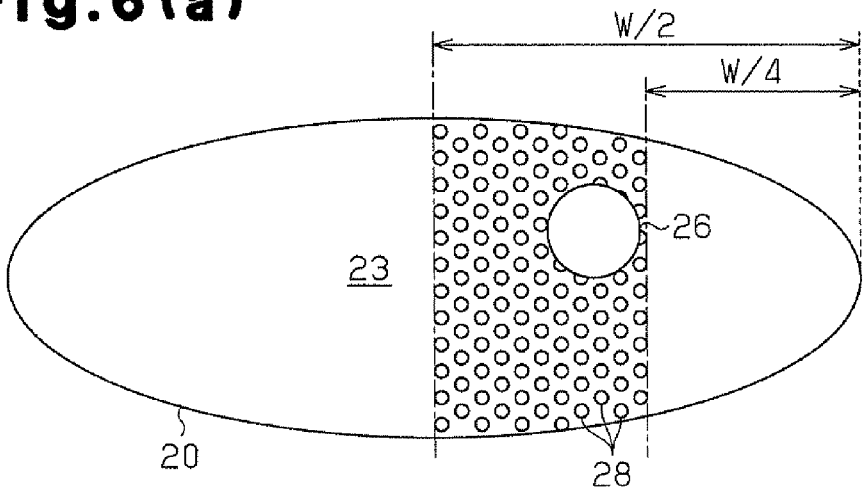
FIGS. 6(*a*) to 6(*c*) show layout of openings and a communication hole in expansion chambers of the muffler of the second embodiment.
Figure 6B:
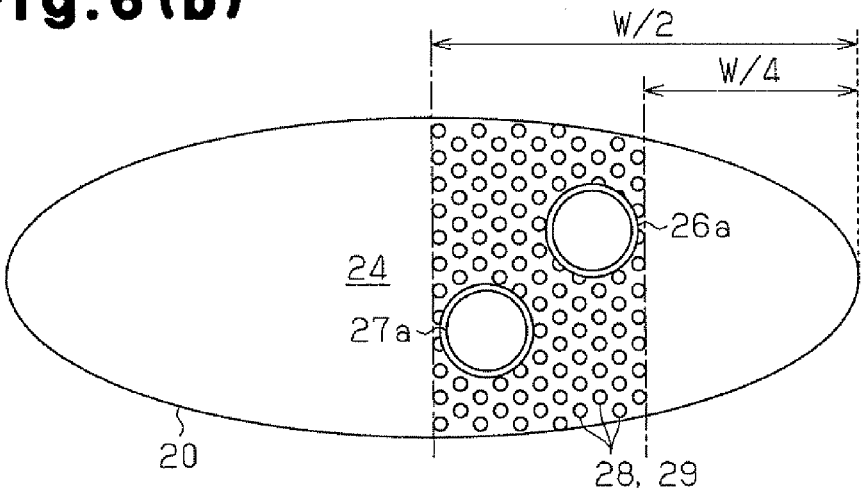
Figure 6C:
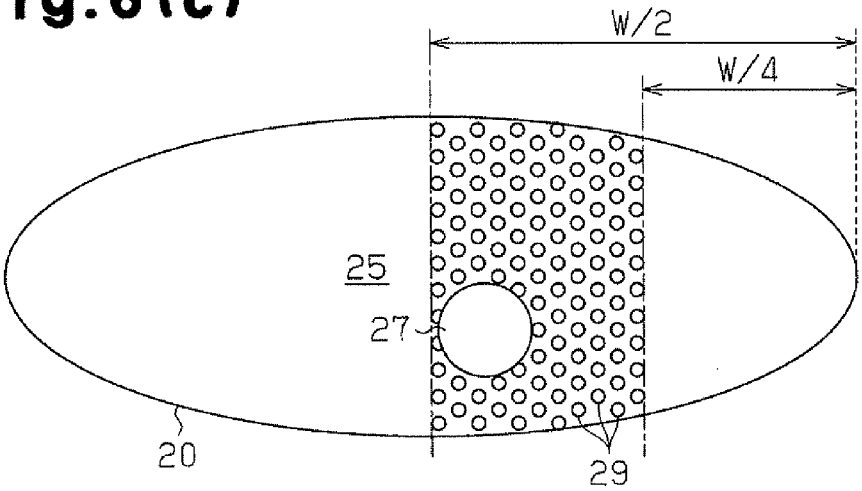

As shown in FIG. 6(*a*), the first expansion chamber 23 of the muffler 20 is open to the outside through the punch holes 28 formed in a range from a position separated away from a right end of the muffler 20 in the width direction in the drawing by the ¼ length of the width W and a position separated away from the right end by the ½ length of the width W.

As shown in FIG. 6(*b*), the second expansion chamber 24 of the muffler 20 is open to the outside through the punch holes 28 and 29 and the openings 26*a* and 27*a* of the inlet pipe 26 and the outlet pipe 27. The punch holes 28, the punch holes 29 and the openings 26*a* and 27*a* of the inlet pipe 26 and the outlet pipe 27 are arranged such that all of them fall in a range from a position separated away from the right end of the muffler 20 in the drawing in the width direction by the length W/4 to a position separated away from the right end by the length W/2.

Further, as shown in FIG. 6(*c*), the third expansion chamber 25 of the muffler 20 is open to the outside through the punch holes 29 formed in a range from a position separated away from the right end of the muffler 20 in the drawing in the width direction by the ¼ length of the width W and a position separated away from the right end by the ½ length of the width W.

As described above, according to the muffler 20, the openings 26*a* and 27*a* of the inlet pipe 26 and the outlet pipe 27 and the punch holes 28 and 29, which are communication holes extending through the first partition plate 21 and the second partition plate 22, are arranged such that all of them fall between the position separated away from the one end of the muffler 20 in the width direction by the ¼ length of the width W and the position separated away from the end by the ½ length of the width W. Hence, according to the silencing apparatus for a vehicle of this embodiment also, the same advantages as those described in (1) to (4) are achieved.

Third Embodiment

Next, a silencing apparatus for a vehicle according to a third embodiment of the invention will be described with reference to FIGS. 7 and 8.

Figure 7A:
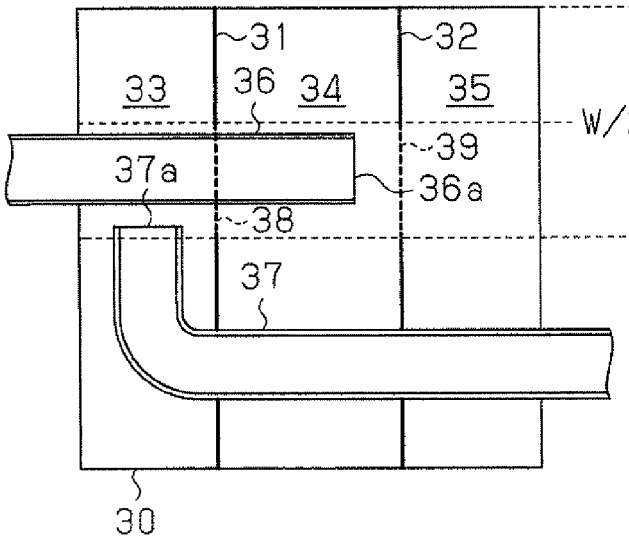
FIG. 7(*a*) is a cross-sectional view showing a flattened cross-sectional structure of a muffler in a silencing apparatus for a vehicle according to a third embodiment of the invention.
Figure 7B:
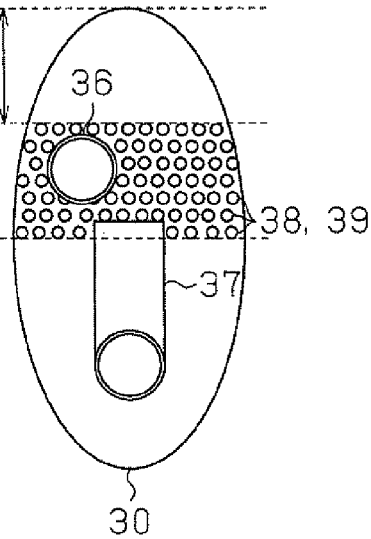

As shown in FIGS. 7(*a*) and 7(*b*), the interior of a muffler 30 having a flattened cross-sectional shape is divided by a first partition plate 31 and a second partition plate 32 into three spaces, i.e., a first expansion chamber 33, a second expansion chamber 34 and a third expansion chamber 35. The expansion chambers 33 to 35 are formed such that the length of each expansion chamber in the front-rear direction of the muffler 30 is not less than ¼ of the width W of the muffler 30.

A circular inlet pipe 36, through which exhaust is introduced into the muffler 30, is arranged such that a tip end of the inlet pipe 36 extends through the first partition plate 31 and opens into the second expansion chamber 34. A circular outlet pipe 37, through which exhaust is discharged from the muffler 30, extends through the second partition plate 32 and the first partition plate 31 and then, the outlet pipe 37 is curved in the width direction of the muffler 30 (upward in the drawing), and a tip end of the outlet pipe 37 opens into the first expansion chamber 33. Openings of the inlet pipe 36 and the outlet pipe 37 are arranged such that all of the openings fall between a position separated away from one end (upper end in the drawing) of the muffler 30 in the width direction by the ¼ length of the width W of the muffler 30 and a position separated away from the end by the ½ length of the width W.

A large number of punch holes 38 and 39 are formed in the first partition plate 31 and the second partition plate 32 of the muffler 30. The punch holes 38 and 39 are formed between a position separated away from the one end (upper end in the drawing) of the muffler 30 in the width direction by the ¼ length of the width W of the muffler 30 and a position separated away from the end by the ½ length of the width W. Communication holes, which extend between the first expansion chamber 33 and the second expansion chamber 34, are formed by the punch holes 38 formed in the first partition plate 31, and communication holes, which extend between the second expansion chamber 34 and the third expansion chamber 35, are formed by the punch holes 39 formed in the second partition plate 32.

Figure 8A:
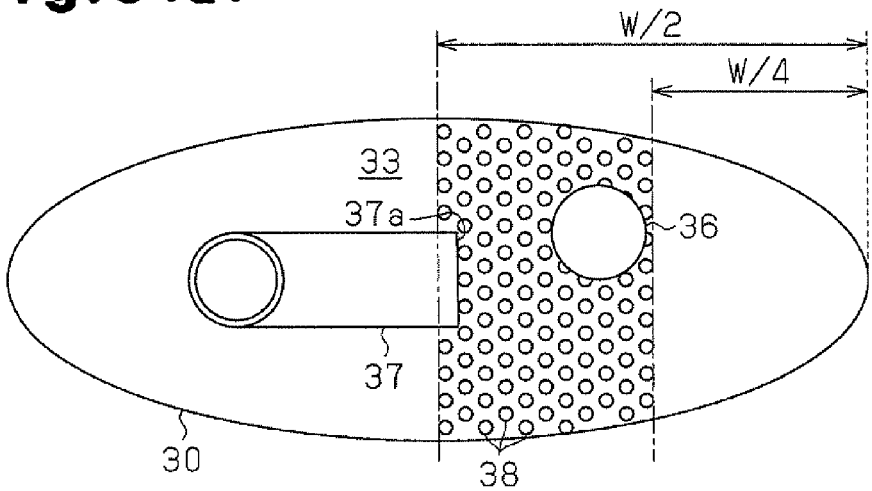
FIGS. 8(*a*) to 8(*c*) show layout of openings and a communication hole in expansion chambers of the muffler of the third embodiment.
Figure 8B:
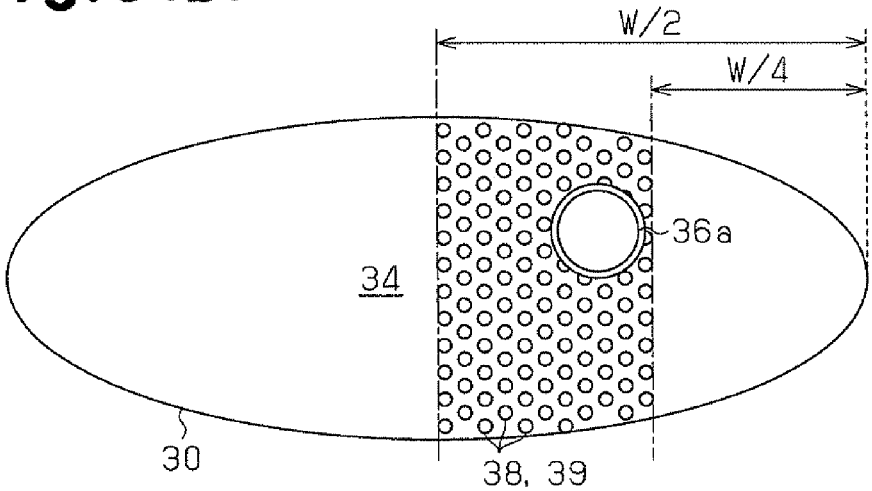
Figure 8C:
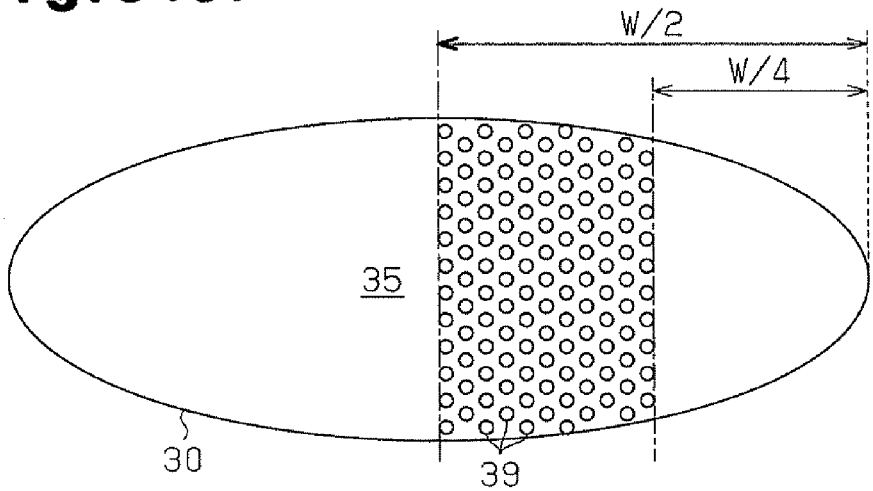

As shown in FIG. 8(*a*), the first expansion chamber 33 of the muffler 30 is open to the outside through the punch holes 38 and the opening 37*a* of the outlet pipe 37 formed in a range from a position separated away from a right end of the muffler 30 in the width direction in the drawing by the ¼ length of the width W and a position separated away from the right end by the ½ length of the width W.

As shown in FIG. 8(*b*), the second expansion chamber 34 of the muffler 30 is open to the outside through the punch holes 38 and 39 and the opening 36*a* of the inlet pipe 36. The punch hole 38, the punch hole 39 and the opening 36*a* of the inlet pipe 36 are arranged such that they fall in a range from a position separated away from the right end of the muffler 30 in the drawing in the width direction by the ¼ length of the width W and a position separated away from the right end by the ½ length of the width W.

Further, as shown in FIG. 8(*c*), the third expansion chamber 35 of the muffler 30 is open to the outside through the punch holes 39 formed in a range from a position separated away from the right end of the muffler 30 in the drawing in the width direction by the ¼ length of the width W and a position separated away from the right end by the ½ length of the width W.

As described above, according to the muffler 30, the openings of the inlet pipe 36 and the outlet pipe 37 and the punch holes 38 and 39, which are communication holes extending through the first partition plate 31 and the second partition plate 32, are arranged such that all of them fall between the position separated away from the one end of the muffler 30 in the width direction by the length W/4 and the position separated away from the end by the length W/2. Hence, according to the silencing apparatus for a vehicle of this embodiment also, the same advantages as those described in (1) to (4) are achieve.

Fourth Embodiment

Next, a silencing apparatus for a vehicle according to a fourth embodiment of the invention will be described with reference to FIGS. 9 and 10.

Figure 9A:
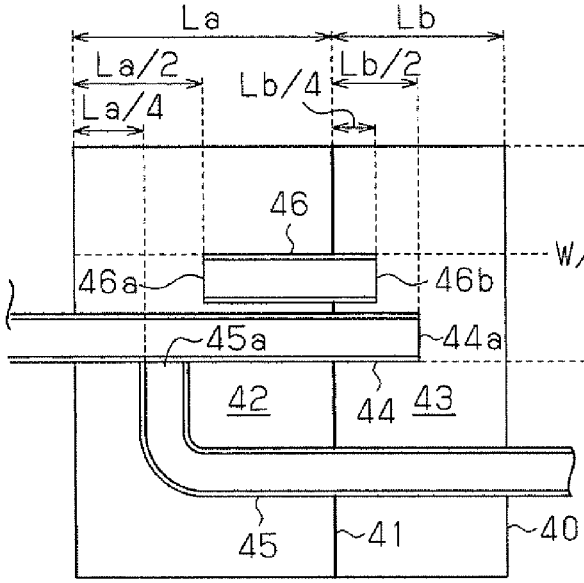
FIG. 9(*a*) is a cross-sectional view showing a flattened cross-sectional structure of a muffler in a silencing apparatus for a vehicle according to a fourth embodiment of the invention.
Figure 9B:
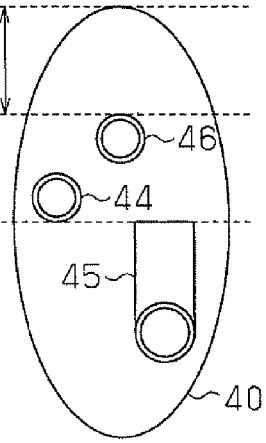

As shown in FIGS. 9(*a*) and 9(*b*), the interior of a muffler 40 having a flattened cross-sectional shape is divided by a partition plate 41 into two spaces, i.e., a first expansion chamber 42 and a second expansion chamber 43. The expansion chambers 42 and 43 are formed such that the length of each expansion chamber in the front-rear direction of the muffler 40 is not less than ¼ of the width W of the muffler 40.

A circular inlet pipe 44, through which exhaust is introduced into the muffler 40, is arranged such that a tip end of the inlet pipe 44 extends through the partition plate 41 and opens into the second expansion chamber 43. A circular outlet pipe 45, through which exhaust is discharged from the muffler 40, is arranged such that the outlet pipe 45 extends through the partition plate 41 and then, it is curved in the width direction of the muffler 40 (upward in the drawing), and a tip end of the outlet pipe 45 opens into the first expansion chamber 42. An opening 44*a* of the inlet pipe 44 is arranged such that a lower end of the opening 44*a* in the drawing is in contact with a position separated away from one end (upper end in the drawing) of the muffler 40 in the width direction by a ½ length of the width W of the muffler 40. An opening 45*a* of the outlet pipe 45 is located at a position separated away from the one end (upper end in the drawing) of the muffler 40 in the width direction by the ½ length of the width W of the muffler 40.

In the muffler 40, the opening 44*a* of the inlet pipe 44 is located at a position separated away from the partition plate 41 by a ½ length (Lb/2) of a length Lb of the second expansion chamber 43 in the front-rear direction of the muffler. A left end in the drawing of an opening 45*a* of the outlet pipe 45 is located at a position separated away from a tip end of the muffler 40 by a ¼ length (La/4) of a length La of the first expansion chamber 42 in the front-rear direction of the muffler.

A circular communication pipe 46 is arranged such that it extends through the partition plate 41 of the muffler 40. The communication pipe 46 is arranged such that its upper end in the drawing is in contact with a position separated away from an upper end of the muffler 40 in the drawing by a ¼ length (W/4) of the width W of the muffler 40 in the width direction thereof. An opening 46*a* of the communication pipe 46 at a front portion (left in the drawing) of the muffler is located at a position separated away from a tip end of the muffler 40 by a ½ length (La/2) of the length La of the first expansion chamber 42 in the front-rear direction of the muffler. An opening 46*b* of the communication pipe 46 at a rear portion (right in the drawing) of the muffler is located at a position separated away from the partition plate 41 by a ¼ length (Lb/4) of the length Lb of the second expansion chamber 43 in the front-rear direction of the muffler.

Figure 10A:
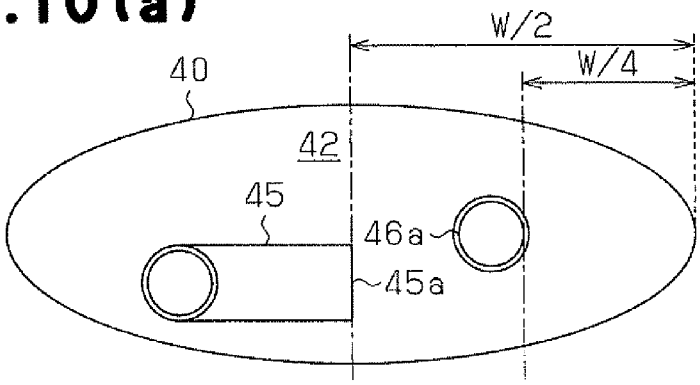
FIGS. 10(*a*) and 10(*b*) show layout of openings and a communication hole in expansion chambers of the muffler of the fourth embodiment.
Figure 10B:
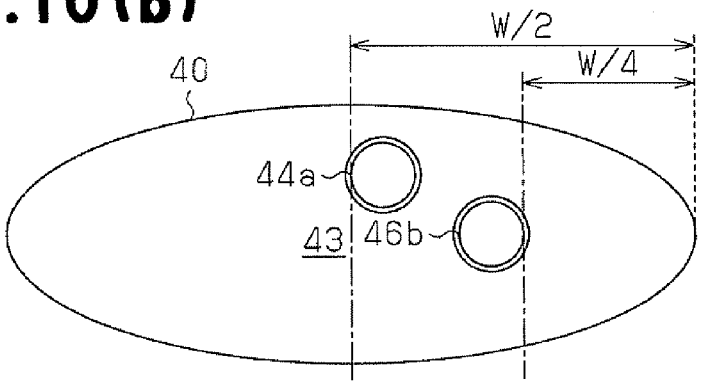
Figure 11:
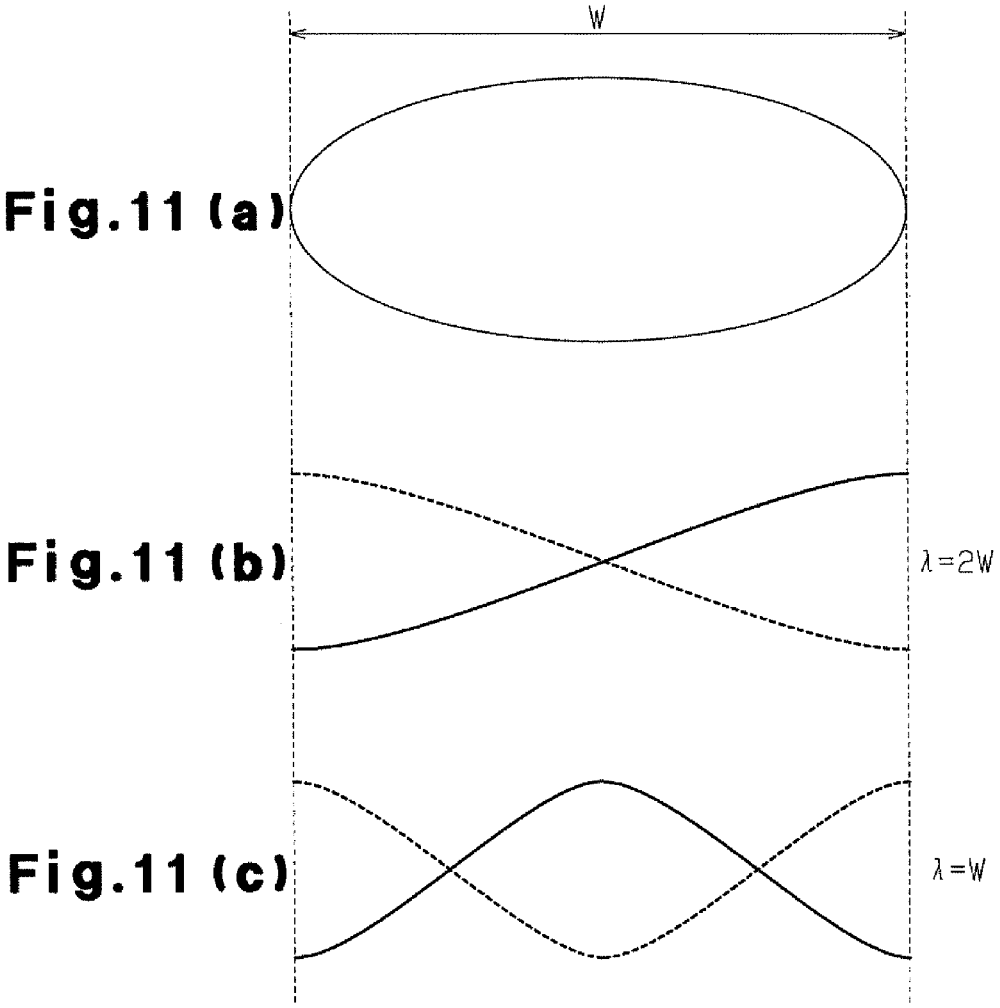
FIG. 11(*a*) is a cross-sectional front view showing a cross-sectional structure of a muffler having a flattened cross-sectional shape.

As shown in FIG. 10(*a*), the first expansion chamber 42 of the muffler 40 is open to the outside through the opening 46*a* of the communication pipe 46 and the opening 45*a* of the outlet pipe 45. The opening 46*a* of the communication pipe 46 is arranged such that the opening 46*a* is in contact with a position separated away from the right end of the muffler 40 in the drawing in the width direction by the ¼ length of the width W. The opening 45*a* of the outlet pipe 45 is located at a position separated away from the right end of the muffler 40 by the ½ length of the width W. As shown in FIG. 10(*b*), the second expansion chamber 43 of the muffler 40 is open to the outside through the opening 46*b* of the communication pipe 46 and the opening 44*a* of the inlet pipe 44. The opening 46*b* of the communication pipe 46 is arranged such that the opening 46*b* is in contact with a position separated away from the right end of the muffler 40 in the drawing in the width direction by the ¼ length of the width W. The opening 44*a* of the inlet pipe 44 is arranged such that the opening 44*a* is in contact with a position separated away from the right end of the muffler 40 by the ½ length of the width W.

As described above, according to the muffler 40, all of the openings 44*a* and 45*a* of the inlet pipe 44 and the outlet pipe 45 as well as the communication pipe 46 forming the communication hole, which extends through the partition plate 41, fall between the position separated away from the one end of the muffler 40 in the width direction by the ¼ length of the width W and the position separated away from the end by the ½ length of the width W. Hence, according to the silencing apparatus for a vehicle of this embodiment also, the same advantages as those described in (1) to (4) are achieved.

In the embodiment, the expansion chambers 42 and 43 are open to the outside at the positions separated away from the one end of the muffler in the longitudinal direction by the ¼ lengths of the lengths La and Lb and the positions separated away from the end of the muffler by the ½ lengths of the length La and Lb. According to the muffler 40, the sound-absorbing effect on the air column resonance in the longitudinal direction of the muffler of the expansion chambers 42 and 43 is exerted by the same principle as that of the sound-absorbing effect on the air column resonance in the width direction. Hence, according to the embodiment, it is possible to effectively suppress the increase in exhaust sound caused by the air column resonance in the longitudinal direction of the muffler.

The above-described embodiments may be modified in the following manners.

Although the expansion chambers are brought into communication with each other through the circular communication pipe arranged to extend through the partition wall in the first and fourth embodiments, a hole (communication hole) may be formed in the partition plate and the expansion chambers may be brought into communication with each other through the hole. In this case also, if all of the hole and openings of the inlet pipe and the outlet pipe are arranged such that they fall between the position separated away from one end of the muffler in the width direction by the ¼ length of the width W and the position separated away from the end by the ½ length of the width W, it is possible to effectively suppress the increase in exhaust sound caused by the air column resonance in the width direction of the muffler.

The arrangement of the openings of the inlet pipe and the outlet pipe and the communication hole may be changed as required. In this case also, if all of them are arranged such that they fall between the position separated away from the one end of the muffler in the width direction by the ¼ length of the width W and the position separated away from the end by the ½ length of the width W, it is possible to effectively suppress the increase in exhaust sound caused by the air column resonance in the width direction of the muffler.

The number of the partition plates and the expansion chambers provided in the muffler may be changed as required. The number of the communication pipes and the communication holes may be changed as required also.

Although the expansion chambers are formed such that the length of each expansion chamber in the front-rear direction of the muffler becomes not less than ¼ of the width W of the muffler in the above embodiments, a portion or all of them may have a length less than ¼ of the width W of the muffler.

DESCRIPTION OF THE REFERENCE NUMERALS

1 . . . muffler, 2 first partition plate, 3 . . . second partition plate, 4 . . . first expansion chamber, 5 . . . second expansion chamber, 6 . . . third expansion chamber, 7 . . . inlet pipe (7*a* . . . opening), 8 . . . outlet pipe (8*a* . . . opening), 9 . . . first communication pipe (communication hole: 9*a*, 9*b* opening), 10 . . . second communication pipe (communication hole: 10*a*, 10*b* . . . opening), 11 . . . third communication pipe (communication hole: 11*a*, 11*b* . . . opening), 20 . . . muffler, 21 . . . first partition plate, 22 . . . second partition plate, 23 . . . first expansion chamber, 24 . . . second expansion chamber, 25 . . . third expansion chamber, 26 . . . inlet pipe (26*a* . . . opening), 27 . . . outlet pipe (27*a* . . . opening), 28 . . . punch hole (communication hole), 29 . . . punch hole (communication hole), 30 . . . muffler, 31 . . . first partition plate, 32 . . . second partition plate, 33 . . . first expansion chamber, 34 . . . second expansion chamber, 35 . . . third expansion chamber, 36 . . . inlet pipe (36*a* . . . opening), 37 . . . outlet pipe (37*a* . . . opening), 38 . . . punch hole (communication hole), 39 . . . punch hole (communication hole), 40 . . . muffler, 41 . . . partition plate, 42 . . . first expansion chamber, 43 . . . second expansion chamber, 44 inlet pipe (44*a* . . . opening), 45 . . . outlet pipe (45*a* . . . opening), 46 . . . communication pipe (communication hole: 46*a*, 46*b* . . . opening), 50 . . . muffler, 51 . . . expansion chamber, 52 . . . opening, 53 . . . opening

The invention claimed is:

1. A silencing apparatus for a vehicle, the apparatus comprising:

a muffler having a flattened cross-sectional shape with a height and a width, the width being greater than the height, the width being measured from a first side end of the muffler to a second side end of the muffler opposite the first side end of the muffler;

an inlet pipe, through which exhaust is introduced into the muffler;

an outlet pipe, through which exhaust is discharged from the muffler;

a partition plate, which partitions an interior of the muffler to form a plurality of expansion chambers; and a communication hole, which extends through the partition plate, wherein an entirety of (1) an opening of the inlet pipe, (2) an opening of the outlet pipe, and (3) the communication hole lie between a first position separated from the first side end in a width direction of the muffler by ¼ of the width and a second position separated from the first side end in the width direction by ½ of the width.

2. The silencing apparatus according to claim 1, wherein at least one of a first circumferential surface defining the opening of the inlet pipe, a second circumferential surface defining the opening of the outlet pipe, and a third circumferential surface defining the communication hole intercepts the first position, and at least one remaining one of the first circumferential surface, the second circumferential surface, and the third circumferential surface intercepts the second position.

3. A silencing apparatus for a vehicle, the apparatus comprising:

a muffler having a flattened cross-sectional shape with a height and a width, the width being greater than the height, the width being measured from a first side end of the muffler to a second side end of the muffler opposite the first side end of the muffler;

an inlet pipe, through which exhaust is introduced into the muffler;

an outlet pipe, through which exhaust is discharged from the muffler;

a partition plate, which partitions an interior of the muffler to form a plurality of expansion chambers; and a communication hole, which extends through the partition plate, wherein each of the plurality of expansion chambers is open to an outside of the respective expansion chamber only in a region between a first position separated from the first side end in a width direction of the muffler by ¼ of the width and a second position separated from the first side end in the width direction by ½ of the width.

* * * * *